US008448545B1

(12) United States Patent
Argyle

(10) Patent No.: US 8,448,545 B1
(45) Date of Patent: May 28, 2013

(54) BENDER BAR SPEEDWRENCH 4-IN-1 MULTI-TOOL

(76) Inventor: Douglas B. Argyle, Roy, UT (US)

( * ) Notice: Subject to any disclaimer, the term of this patent is extended or adjusted under 35 U.S.C. 154(b) by 335 days.

(21) Appl. No.: 13/039,149

(22) Filed: Mar. 2, 2011

Related U.S. Application Data

(60) Provisional application No. 61/309,930, filed on Mar. 3, 2010.

(51) Int. Cl.
*B25G 3/02* (2006.01)

(52) U.S. Cl.
USPC ..... 81/28; 81/177.6; 81/177.7; 81/177.85

(58) Field of Classification Search
USPC ..... 81/28, 177.6, 177.7, 177.85
See application file for complete search history.

(56) References Cited

U.S. PATENT DOCUMENTS

| | | | | |
|---|---|---|---|---|
| 1,169,496 | A * | 1/1916 | Knauff | 403/100 |
| 1,431,389 | A | 10/1922 | Frisz | |
| 1,609,732 | A | 12/1926 | McLaughlin et al. | |
| 2,284,871 | A | 6/1942 | Huss | |
| 3,649,976 | A | 3/1972 | Isom | |
| 3,779,106 | A | 12/1973 | Cavicchi | |
| 3,872,527 | A | 3/1975 | Tregoning | |
| 3,973,283 | A | 8/1976 | Boe | |
| 4,334,445 | A | 6/1982 | Timewell | |
| 4,607,406 | A | 8/1986 | Davis, Jr. | |
| 4,733,583 | A | 3/1988 | Lewis | |
| 4,765,009 | A | 8/1988 | Hung | |
| 4,811,440 | A | 3/1989 | Scott | |
| 4,920,592 | A | 5/1990 | Scott | |
| 5,201,257 | A | 4/1993 | Engel | |
| 5,367,732 | A | 11/1994 | Suggs, Sr. | |
| 5,421,180 | A | 6/1995 | Rojdev | |
| 6,076,424 | A | 6/2000 | McMurtrey et al. | |
| 6,125,725 | A | 10/2000 | Fox et al. | |
| 6,662,688 | B1 * | 12/2003 | Avery | 81/124.5 |
| 7,086,664 | B2 | 8/2006 | Voegeli, Jr. et al. | |
| 2009/0038081 | A1 | 2/2009 | Berton et al. | |

FOREIGN PATENT DOCUMENTS

| | | |
|---|---|---|
| FR | 2657038 | 7/1991 |
| GB | 2050899 | 1/1981 |

* cited by examiner

*Primary Examiner* — Joseph J Hail
*Assistant Examiner* — Shantese McDonald
(74) *Attorney, Agent, or Firm* — Workman Nydegger

(57) ABSTRACT

A collapsible, multi-use tool for use in changing a flat tire includes a tool body having a first end including a curved chisel surface and a second end including a ratchet drive head. A central portion of the tool connects the two end portions, the ends of which are hingedly connected to the adjacent first and second ends. Sliding sleeves are disposed over the first and second ends and can be slid towards one another so as to cover the central portion of the tool and the hinged connections to keep the tool in a linear configuration that provides excellent leverage for breaking lug nuts loose. One of the sliding sleeves may be flared at one end so as to receive an end of the other sliding sleeve when coupled together.

20 Claims, 12 Drawing Sheets

BENDER BAR SPEEDWRENCH 4-IN-1 MULTI-TOOL

CROSS-REFERENCE TO RELATED APPLICATION

This application claims the benefit of U.S. Provisional Patent Application No. 61/309,930, filed Mar. 3, 2010, the disclosure of which is incorporated herein in its entirety.

BACKGROUND OF THE INVENTION

1. The Field of the Invention

The present invention is in the field of multi-tools that can be used to perform basic functions associated with changing a tire.

2. The Relevant Technology

The present invention relates to automotive vehicles, and particularly to combination tools useful in tasks associated with removal and replacement of a flat tire. Often, a flat head screwdriver may be used to pry off a hubcap, while a star type lug nut wrench (e.g., including 2 rods in a cross-shape with sockets at each end of each rod so the sockets are each spaced 90° apart) is then used to match the appropriate size socket required for the lug nuts, and to remove the lug nuts. A jack (e.g., a scissor type jack) is often used to raise the wheel and tire up off the ground in order to remove the flat tire, and provide sufficient space to put the replacement tire in place. An elongate rotatable lever is often used to raise the jack to the desired height, after which the flat tire is removed, the new tire is seated in place, and the lug nuts are retightened with the star type lug nut wrench.

Existing tools are relatively bulky, taking up significant space within the vehicle, and can sometimes be difficult to use.

BRIEF SUMMARY

The present invention is in the field of collapsible multi-tools that can be used to perform basic functions associated with changing a tire: (1) removing the hubcap; (2) loosening each lug nut; (3) cranking up a jack; and (4) completely removing lug nuts and tire, (5) positioning spare tire, and (6) retightening the lug nuts.

In one embodiment, the tool includes a first end including a chisel surface that may be curved for prying off a hubcap and a second end including a ratchet drive head. A central portion of the tool connects the two end portions, and the connections at each end of the central portion are hingedly connected to the adjacent portions. This allows both the first end and the second end of the tool to be folded so as to assume a more compact configuration. In one embodiment, the tool is capable of assuming a "Z" configuration for use during cranking of the jack. Sliding handles or sleeves can be slid so as to cover the central portion of the tool and the hinged connections to keep the tool in a linear configuration that provides excellent leverage for breaking lug nuts loose.

When the hinged connections are folded for storage or for a "Z" configuration, the sliding sleeves are disposed at the first and second ends of the tool, leaving the flared at one end so as to receive an end of the other sliding sleeves when coupled central portion and hinged connections uncovered. One of the sliding sleeves may be together. A détente, a locking pin and L or J-shaped recess or other locking mechanism may also be provided within the sleeves or adjacent rod body to lock the sliding sleeves together. The sliding sleeves can be broken apart by pulling or twisting both sleeves apart.

A retaining ring may be provided at the first end of the tool to prevent the sliding sleeves from sliding off either end.

BRIEF DESCRIPTION OF THE DRAWINGS

In order that the manner in which the above recited and other benefits, advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings, in which.

DETAILED DESCRIPTION OF THE PREFERRED EMBODIMENTS

I. Introduction

Figure 1A:
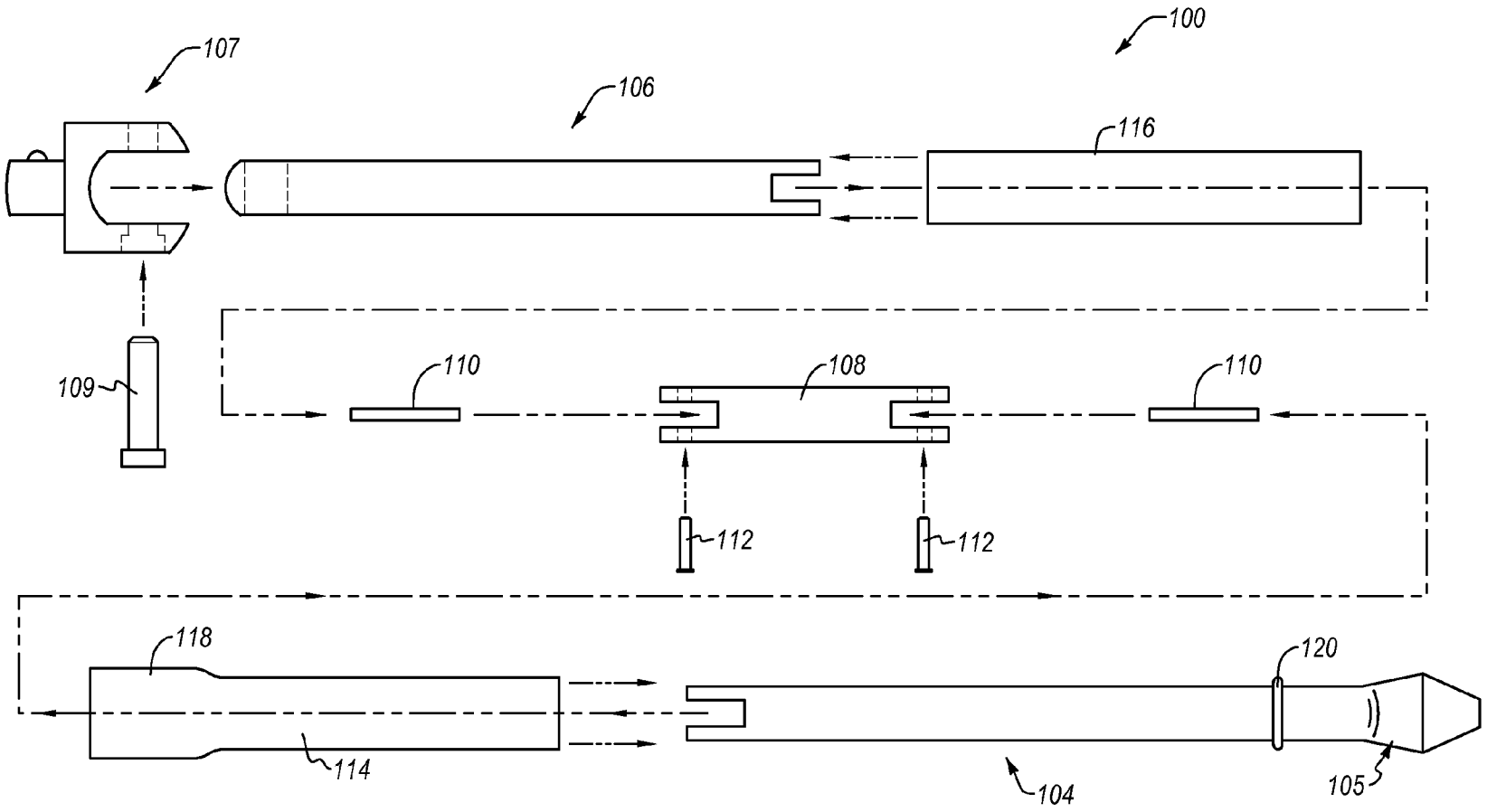
FIG. 1A is an exploded view of an exemplary collapsible multi-tool.
Figure 1B:
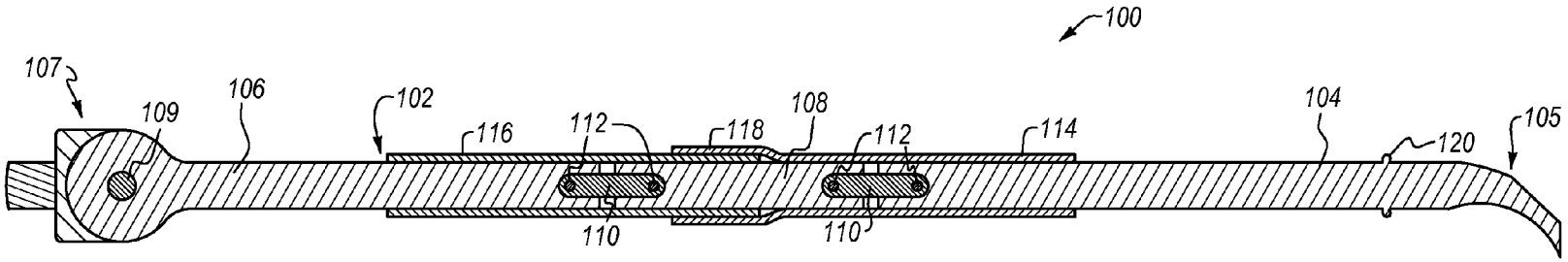
FIG. 1B is a cross-sectional view of the collapsible multi-tool of FIG. 1A in a linear, non-collapsed configuration.

The present invention is in the field of collapsible multi-tools that can be used to perform basic functions associated with changing a tire: (1) removing the hubcap; (2) loosening each lug nut; (3) cranking up a jack; (4) completely removing lug nuts and tire; (5) positioning the spare tire; and 6) retightening the lug nuts.

The tool may include a first end including a curved chisel surface for prying off a hubcap and a second end including a ratchet drive head. A central portion of the tool connects the two end portions, and the connections at each end of the central portion are hingedly connected to the adjacent portions. This allows both the first end and the second end of the tool to be folded so as to assume a more compact configuration, and to also assume a "Z" configuration for use during cranking of the jack. Sliding handles or sleeves can be slid so as to cover the central portion of the tool and the hinged connections to keep the tool in a linear configuration that provides excellent torque or leverage for breaking lug nuts loose.

When the hinged connections are folded for storage or partially folded for a "Z" configuration, the sliding sleeves are disposed at the first and second ends of the tool, leaving the central portion and hinged connections uncovered. One of the sliding handles may be flared at one end so as to receive an end of the other sliding sleeve when coupled together. A détente, a locking pin and cooperating L or J-shaped recess or other locking mechanism may also be provided within the sleeves and/or adjacent rod portion of the body to lock the sliding handles together. The sliding sleeves can be broken apart by twisting or pulling both sleeves apart, depending on the locking mechanism. A retaining ring may be provided at the first end of the tool to prevent the sliding sleeves from sliding off either the chisel end or ratchet end.

II. Exemplary Collapsible Multi-Tool

FIGS. 1A-3B illustrate an exemplary collapsible multi-tool 100 including an elongate tool body 102 including a first end 104 including a curved chisel surface 105 for use in removing a hubcap. An opposite second end 106 includes a ratchet drive head 107. A selected socket is attachable to ratchet drive head 107 for use in removing lug nuts. Ratchet drive head 107 may be held in place by pin 109. The distal coupling head of Ratchet drive head 107 may be of any desired length. For example, it may be about ¾ inch in length for coupling to a standard socket, or it may be longer (e.g., about 1½ inches) for coupling to a deep socket. A central portion 108 is disposed between first end 104 and second end 106. Ratchet drive head 107 may include any size drive (e.g., ¼ inch, ⅜ inch, ½ inch, or even 1 inch).

The tool also includes first and second mating sliding sleeves 114 and 116 respectively. Sleeves 114 and 116 are disposed over first and second ends 104, 106, respectively of body 102 (FIG. 3A) such that the mating sleeves may be slid matingly towards one another so that one sliding sleeve (e.g., second sleeve 116) is received within a flared end 118 of the other (e.g., first sleeve 114) sleeve. When in the mated configuration, the central portion 108 of body 102 is covered by sleeves 114, 116, and at least portions of first and second ends 104 and 106 are also covered by sliding sleeves 114, 116. In this configuration, hinges 112 are covered by sleeves 114, 116 so as to prevent folding of ends 104 and 106, which aids in locking tool body 102 in a linear, non-collapsed configuration.

Figure 3A:
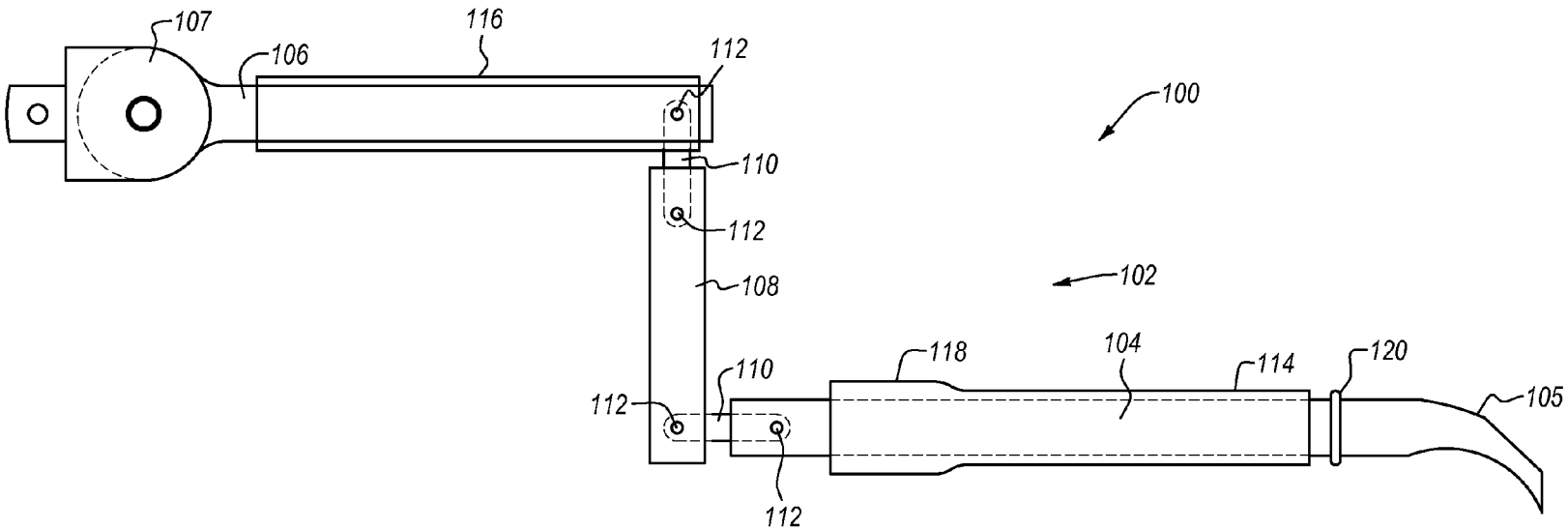
FIG. 3A is a side view of the collapsible multi-tool of FIG. 1A in a Z speedwrench configuration.

Sleeves 114 and 116 may also be fully axially rotatable about the first and second ends 104, 106 when in the Z-shape speedwrench configuration seen in FIG. 3A. This is advantageous as the sleeves serve as spin handles for easy rotation in the Z-shape speedwrench configuration.

Figure 3B:
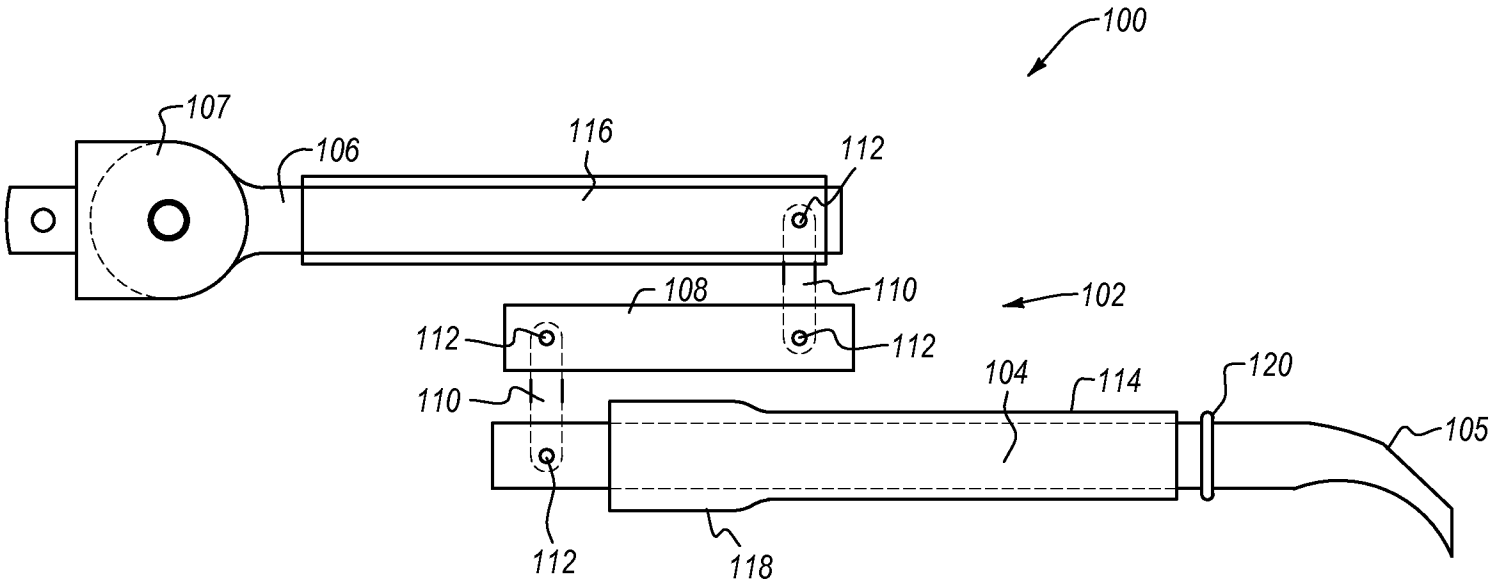
FIG. 3B is a side view of the collapsible multi-tool of FIG. 1A in a fully collapsed storage configuration.

Central portion 108 is hingedly connected to first end 104 and second end 106 (e.g., by hinges 110 and clench pins 112), which allows the first and second ends of tool body 102 to be folded so as to assume a compact storage configuration (FIG. 3B) or a Z-shape speedwrench configuration (FIG. 3A). In the embodiment shown in 3B, the hinges 110 are hinged at both ends of the hinge. Other configurations are possible, for example, one end of the hinge 110 may be fixed relative to either central portion 108 or the adjacent end 104 or 106. In one embodiment, the hinge 110 may be non-hingedly fixed at its connection to central portion 108. In another embodiment, the hinged connection may be at central portion 108, while the connection with end 104 and 106 is non-hingedly fixed. Such a configuration will not fold to as compact a configuration as shown in FIG. 3B, but may also provide additional stability in the Z-configuration (i.e., it will not overfold, past the Z-configuration).

Central portion 108 may further include a retaining shoulder protrusion, for example an annular ring (e.g., approximately centrally disposed along length of central portion 108) for preventing second sleeve 116 from sliding past the center of central portion 108. Although a circumferentially extending ring may be preferred, any protrusion (e.g., a raised button) could alternatively serve to prevent either sleeve from sliding past the location of such a protrusion.

The mating sliding sleeves 114, 116 may further comprise a détente and a corresponding receiving recess for locking the tool body in a linear, non-collapsed configuration, which increases stability when the tool is in the elongate, breaker bar position for providing maximum torque, e.g., for removal of lug nuts. Alternatively, a pin within one sleeve and a recess (e.g., an "L" or "J" shaped curved slot) may be formed within the other sleeve so that the pin slides into the straight leg of the "J" shaped curved slot, and by twisting the handles oppositely relative to one another, the pin is received into the curved portion of the "J" shaped curved slot. In such an embodiment, simply pulling the sleeves apart will not cause the sleeves to separate. The sleeves must be turned again relative to one another to release the pin from the curved portion of the "J" shaped slot, after which pulling the sleeves apart will be effective to cause the sleeves to separate. An "L" shaped slot could provide similar function with the lower leg of the L providing locking reception of the corresponding pin.

A retention ring 120 may be disposed on the first end 104 of the tool body 102 for preventing the first sliding sleeve 114 from sliding off the first end 104. Ratchet drive head 107 prevents sleeve 116 from sliding off second end 106, although another retention ring (not shown) could be provided at that end to prevent sleeve 116 from contacting ratchet 107.

By way of example, tool 100 may be about 26 inches in length when fully extended, which provides for excellent torque for removing lug nuts. Such an exemplary tool may include a first end about 10 inches in length and a second end about 10 inches in length, and a central portion about 6 inches in length. This allows the tool to be folded down to a compact configuration that is about 14 inches total in length. Tool body 102 may be formed of steel (e.g., high strength vanadium high-carbon steel such as HRC-55-62), while sleeves 114 and 116 may also be formed of steel, plastic, or fiberglass. In one embodiment, the tool body is metallic colored, while the sleeves (e.g., where formed of plastic or fiberglass) are of a bright, contrasting highly visible color (e.g., blue, orange, yellow, or red).

Figure 4:
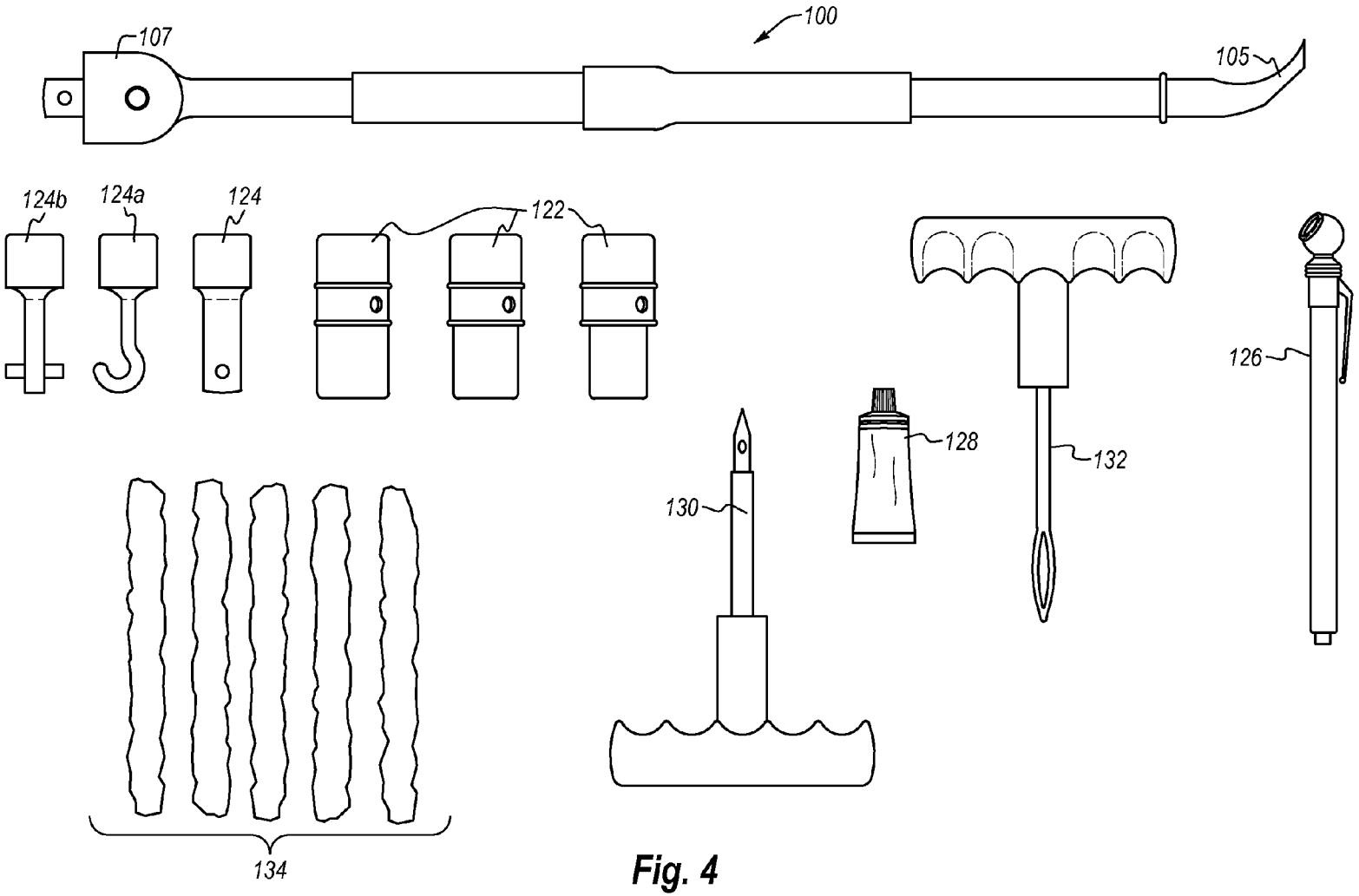
FIG. 4 is a top view of a kit including the collapsible multi-tool of FIG. 1A, as well as a plurality of socket heads, a tire pressure gauge, and tools for repairing a flat tire.

FIG. 4 illustrates the collapsible multi-tool 100 in combination with a kit of variously sized sockets 122, as well as an extender 124 that may be used with ratchet drive head 107. Of course, in embodiments where coupling head of drive head 107 is already extended (e.g., 1½ inches in length), no such extender would be needed. Various other components may be provided, for example a tire pressure gauge 126, as well as tools for repairing a flat tire (e.g., adhesive 128, rasp 130, plug tool 132, and tire repair strings/plugs 134)

Figure 4A:
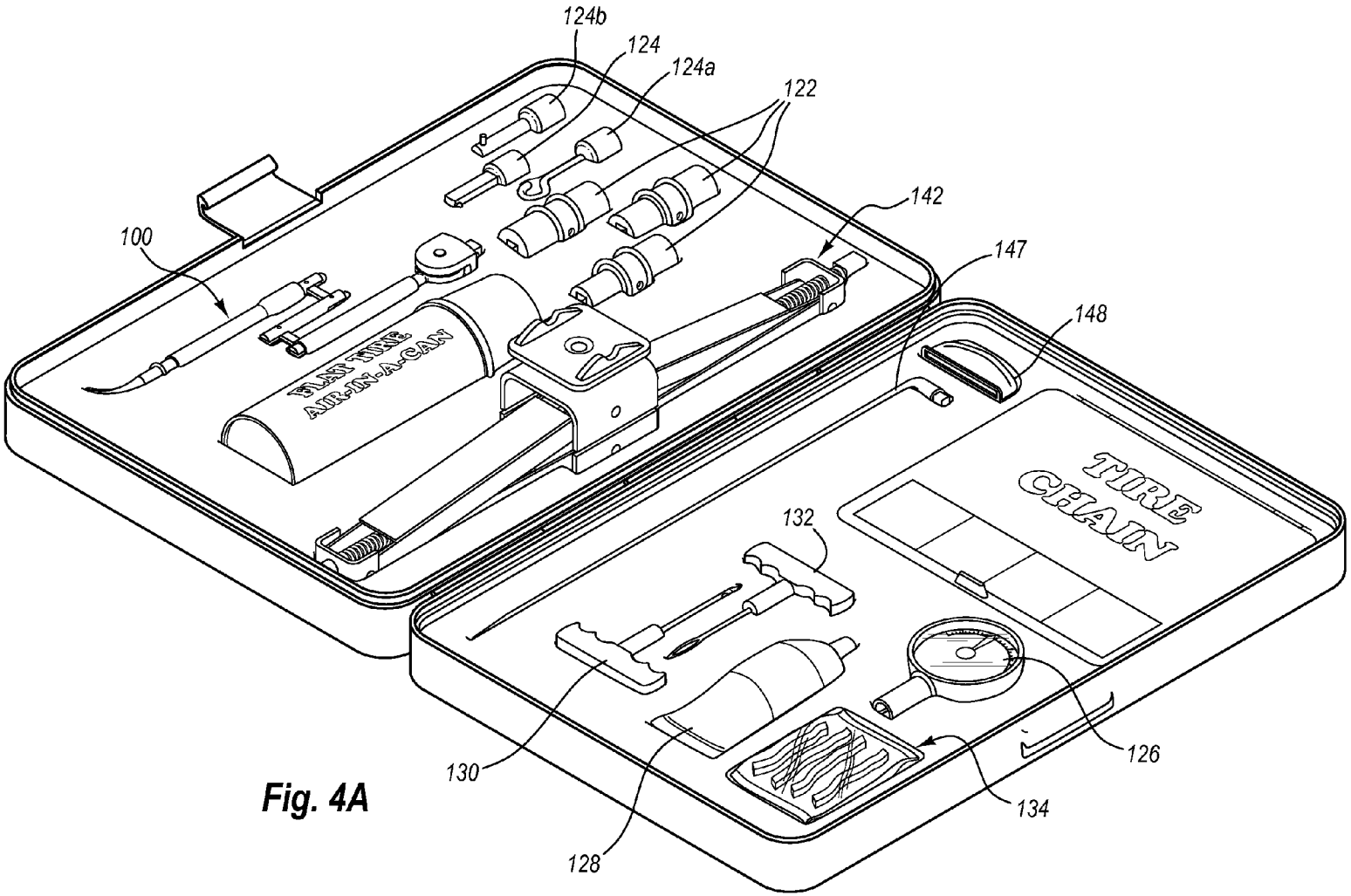
FIG. 4A is a perspective view of a kit similar to that shown in FIG. 4.

Such a kit may be contained within a box including foam or other backing into which the various kit components may be arranged and organized as shown in FIG. 4A. Such a kit may further comprise a tire chain, a dispensing can (e.g., including a propellant) of tire sealant, a jack, or other devices useful in tire replacement and repair.

Figure 5A:
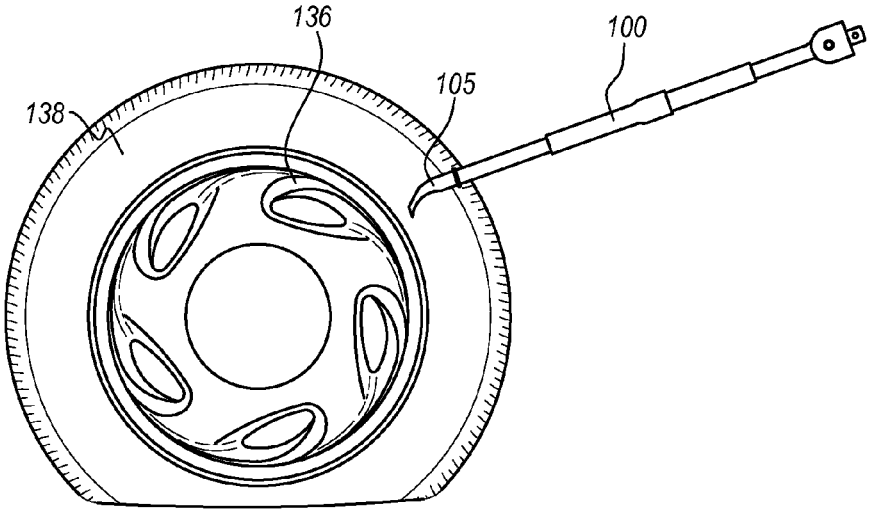
FIG. 5A shows the curved chisel end of the collapsible multi-tool of FIG. 1A being used to remove a hubcap from a flat tire.
Figure 5B:
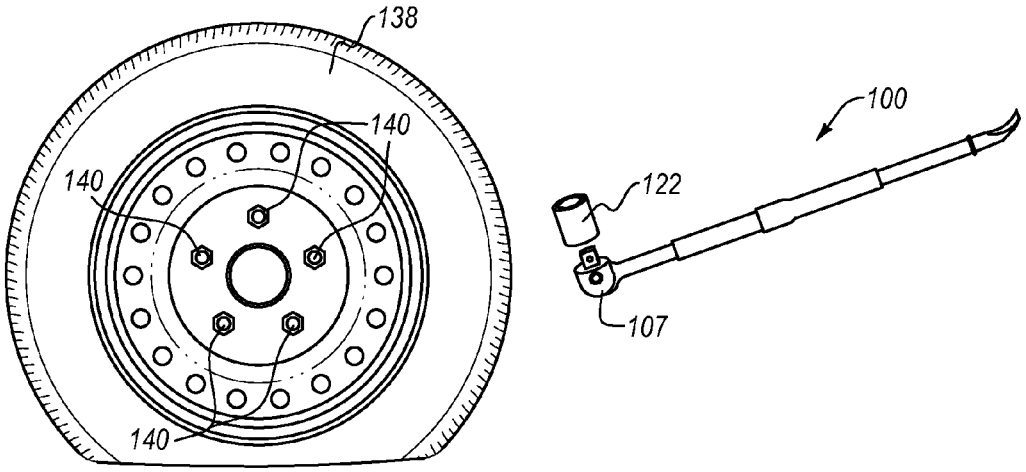
FIG. 5B shows a selected socket head being coupled to the ratchet drive head of the collapsible multi-tool of FIG. 5A for use in loosening and removing lug nuts of the flat tire.
Figure 5C:
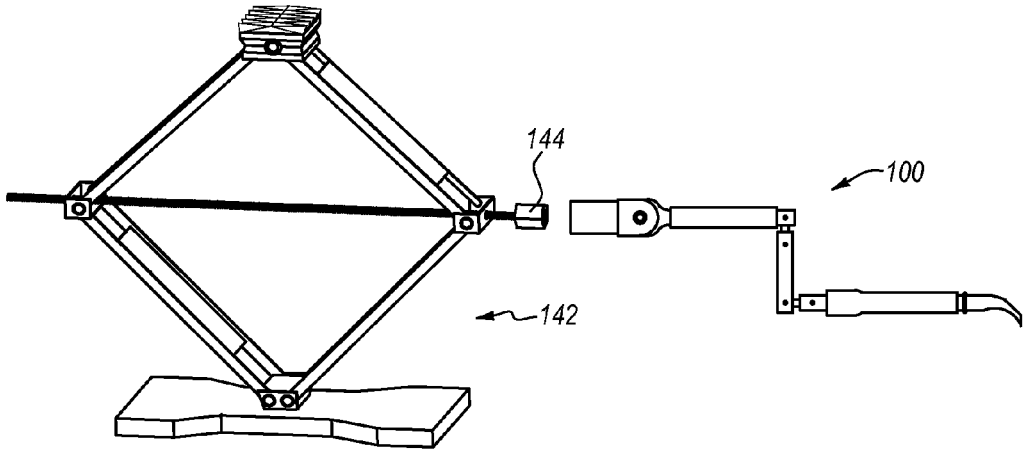
FIG. 5C shows the ratchet drive head end of the collapsible multi-tool being used to raise the jack, raising the flat tire off the ground.
Figure 5D:
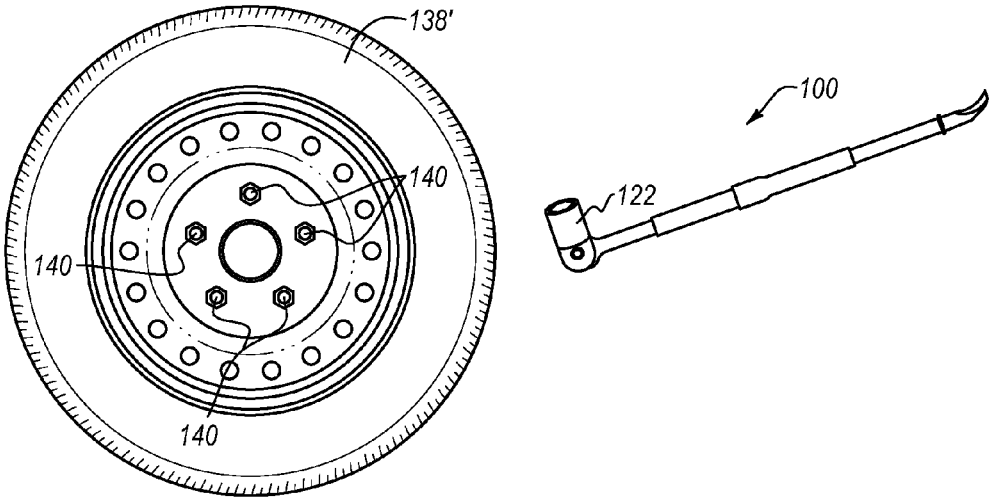
FIG. 5D shows the selected socket head coupled to the ratchet drive head end of the collapsible multi-tool for use in tightening lug nuts of the replacement tire.

FIG. 5A shows the tool 100 in an extended breaker bar configuration in which the curved chisel end 105 is being used to remove hubcap 136 from flat tire 138. As shown in FIG. 5B, an appropriately sized socket 122 (e.g., from a kit similar to that of FIG. 4) is selected and coupled to ratchet drive head 107, with tool 100 still in a locked, elongate, linear breaker bar configuration. Socket 122 coupled to high-torque tool 100 is used to break loose lug nuts 140. As seen in FIG. 5C, slider handles 114, 116 are simply pulled apart, which allows tool 100 to assume a Z-shaped speedwrench configuration, and socket 122 is removed, and the ratchet drive head end 107 is used to raise up jack 142. Although illustrated with a nut type drive head 144 on jack 142, it will be understood that any type drive head may be provided with jack 142. For example, if a hook type jack head is provided (not shown), an adapter 124*a* (FIG. 4) may be provided for coupling onto ratchet drive head 107 so as to couple ratchet drive head 107 to whatever type jack head is provided. Another adapter 124*b* is illustrated that may be used with a slot type jack head. As seen in FIG. 5D, the tool 100 may be pulled into a linear configuration again, and slider sleeves 114, 116 locked into position again for tightening lug nuts 140 of replacement tire 138'.

Figure 6:
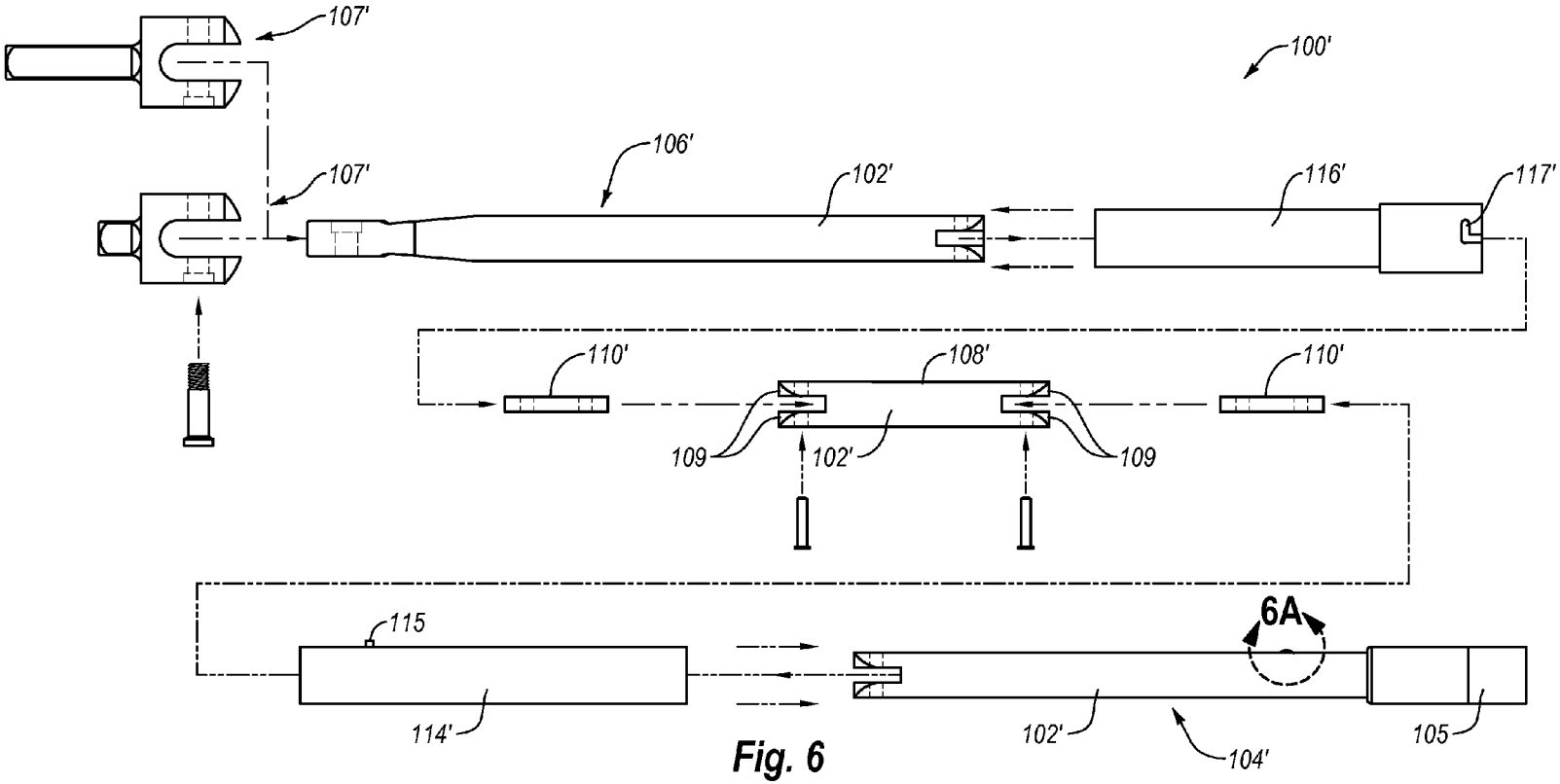
FIG. 6 is an exploded view of another exemplary collapsible multi-tool.

FIG. 6 shows another embodiment of a collapsible multi-tool 100' that is similar to tool 100 that shown in FIG. 1A. Although similar, it is noted that the hinges 110' of tool 100' and the recesses within central portion 108' are particularly configured so that the hinge occupies approximately one-third of the thickness (e.g., diameter) of central portion 108', and each adjacent portion 109' of central portion also occupies about one-third of the thickness. Each portion of the hinged connection thus has an approximately equal thickness, providing very good strength and resistance to unwanted bending of hinges 110'.

Figure 2:
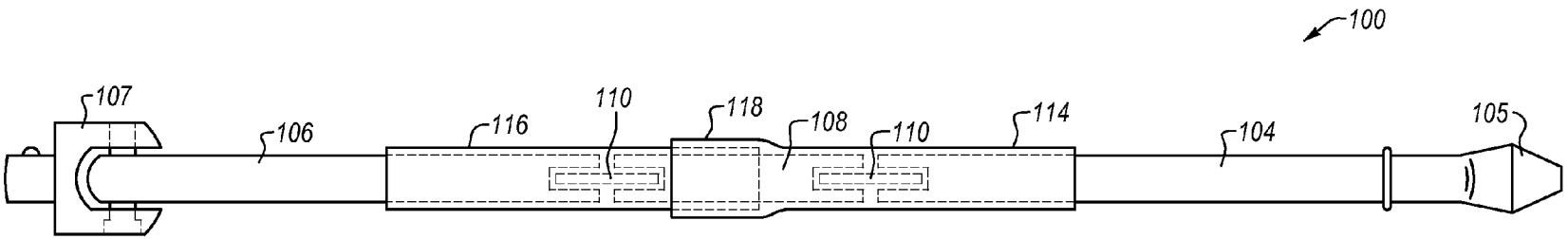
FIG. 2 is a side view of the collapsible multi-tool of FIG. 1A in a linear, non-collapsed configuration.

In addition, it is noted that chiseled end 105 is not flared as that shown in FIG. 2, but is of substantially equal width along its length. Such a chiseled end may more easily couple to a greater depth into the receiving hole of a jack.

Figure 6A:
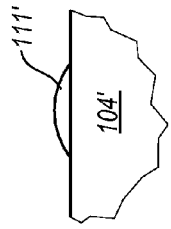
FIG. 6A is a close up view of the ratchet end of the multi-tool of FIG. 6.

Embodiment 100' also shows a protrusion (e.g., a détente 111' shown in FIG. 6A) that may be formed on one or both of end portions 104' and 106' to provide a friction stop against sleeves 114', 116'. For example, if sleeve 114' is adjacent end 104 and the tool is in a vertical position with end 104 "up", then sleeve 114' would tend to drop down under force of gravity. Providing a détente 111' on end portion 104' provides a friction stop to engage sleeve 114' and hold it in place so that it only drops down if the user grabs it and pulls it down. This can prevent pinches, etc. to the user's fingers. A similar détente may be provided on end portion 106' for similarly arresting any gravity induced dropping of sleeve 116'.

Other mechanisms for arresting gravity induced dropping of the sleeves may be employed, e.g., tapering the diameter of ends 104', 106' so as to be wider adjacent the chisel and ratchet ends, respectively. Thus the sleeves 114', 116' may be pushed endward to engage the tapered, flared portion of the body, holding the sleeves in place. Other mechanisms will also be apparent to one of skill in the art, e.g., a retention ring similar to ring 120 but of smaller diameter that "clicks" into a corresponding annular recess formed into the inside diameter of the respective sleeve. A magnet could also be employed in conjunction with a magnetically attractable material that is oppositely disposed (e.g., a magnet placed on the inside of the sleeve that holds the sleeve in place as a result of attraction to a magnetically attractable steel body 102').

FIG. 6 also shows an L-shaped slot 117 formed into an end of sleeve 116' and a corresponding pin or détente 115' sized to fit within slot 117' for locking the tool body 102' in a linear, non-collapsed configuration, which increases stability when the tool 100' is in the elongate, breaker bar position for providing maximum torque. The pin 115' slides into the leg of the "L" slot that is parallel to the longitudinal axis of tool 100', and once pin 115' is fully inserted, the sleeves 114, 116 are twisted oppositely relative to one another so as to cause the pin 115' to be received into the perpendicular portion of slot 117'. In such an embodiment, simply pulling the sleeves apart will not cause the sleeves to separate. The sleeves must be turned again relative to one another to release pin 115' from the locked portion of slot 117', after which pulling the sleeves apart will be effective to cause the sleeves to separate.

FIG. 6 also shows alternate ratchet heads 107' that may be attached to ratchet end 106. For example, one head 107' may include a longer head (e.g., 1.5 inches or 2 inches) than the other.

Figure 7:
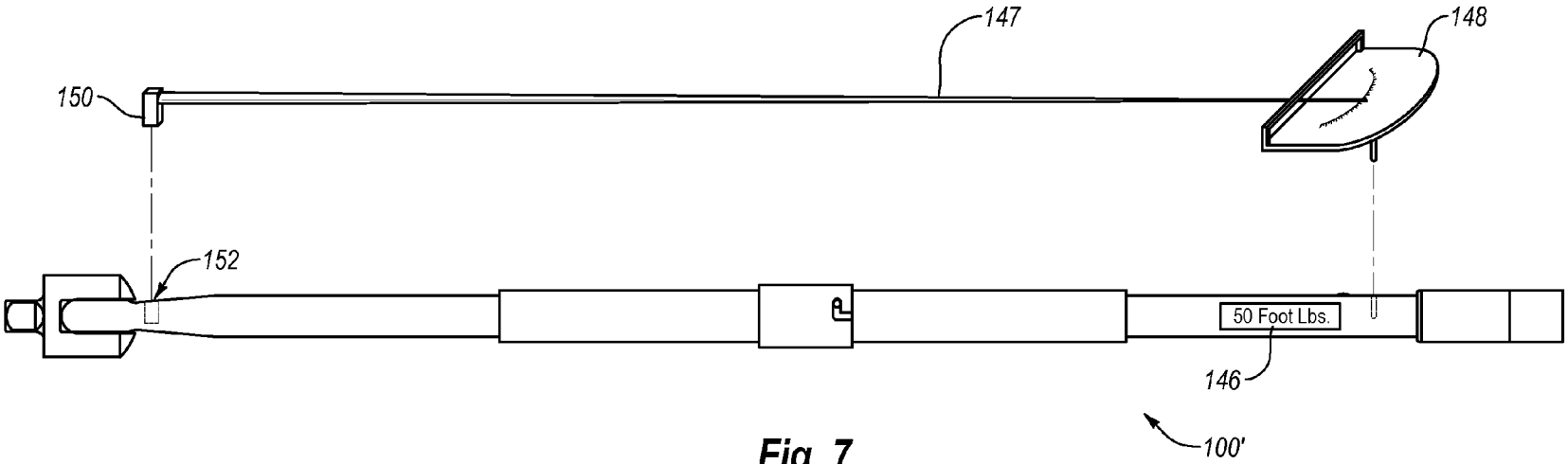
FIG. 7 shows an embodiment of a collapsible multi-tool with a built in torque indicator.

In one embodiment, the multi-tool may include a torque display that shows, e.g., the applied force (e.g., in ft-lbs). FIG. 7 shows such an embodiment. Such a display may comprise a digital read out 146, or a pointer 147 and an analog scale or read out 148. Pointer 147 may include a protrusion 150 that mates within a recess 152 formed near and end of the ratchet end of the tool 100'. Another view of such a pointer and analog scale is shown in the kit of FIG. 4A. In one embodiment, the multi-tool may include a mechanism to apply a desired level of torque, "clicking off" once that level has been reached so as to prevent over-torquing of lug nuts or other structure.

Figure 8:
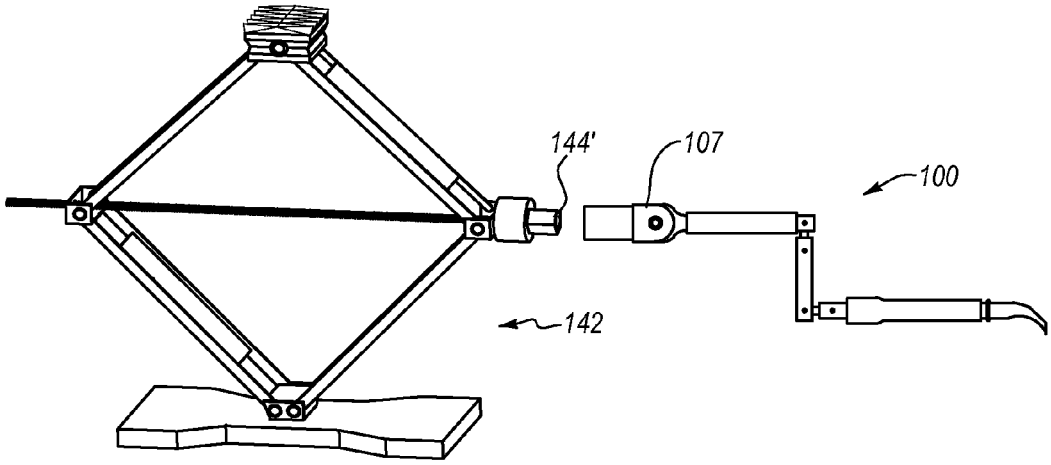
FIG. 8 shows a jack including a ratcheting mechanism for use with the collapsible multi-tool.
Figure 6:
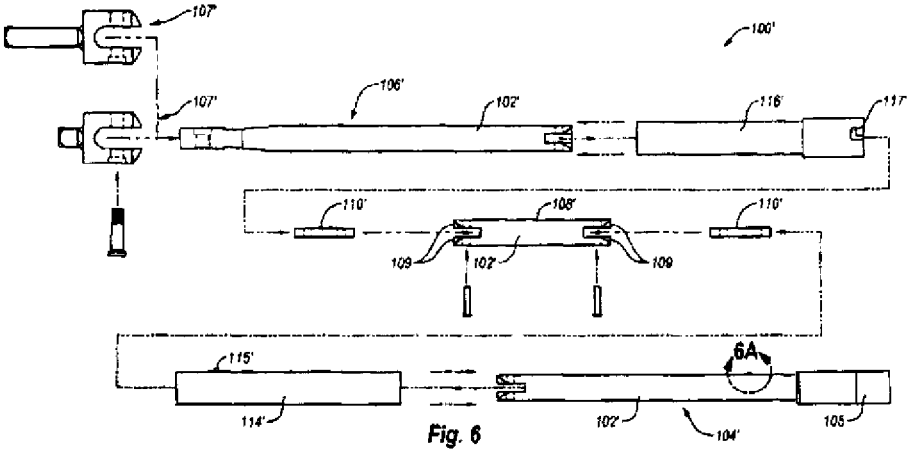
Figure 6A:
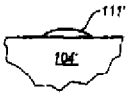

FIG. 8 shows a jack 142 including a ratcheting mechanism 144' so that a reciprocating motion can be used to raise and lower the jack 142. Such a configuration greatly increases the ease of raising the jack 142 during use, particularly as it is not necessary to either rotate the tool 360° or to disengage the tool after each arc rotation and reengage it again. The tool can be rotated e.g., about 45° to about 180°, rotated in the opposite direction back to the starting point, and rotated again. Such a ratchet mechanism 144' may be geared for low force, so that the force applied by the user on the tool body is magnified. In other words, the force applied upwards by the jack 142 may be greater than that applied by the user to the handle (i.e., tool 100). In another embodiment, the rotation mechanism may be incorporated as part of the ratchet head 107 of the multi-tool 100 or 100'.

It will also be appreciated that the present claimed invention may be embodied in other specific forms without departing from its spirit or essential characteristics. For example, the device may be used for loosening/tightening structures other than lug nuts, and may be provided in different sizes for different uses (e.g., smaller version where less leverage is required). The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. A collapsible multi-tool for use in replacing a tire of a vehicle, comprising:

an elongate tool body including a first end including a curved chisel surface for use in removing a hubcap, an oppositely disposed second end including a ratchet drive head to which a selected socket is attachable for use in removing lug nuts, and a central portion disposed between the opposite first and second ends;

the central portion being hingedly connected to the first end of the tool body at one end of the central portion and an opposite end of the central portion also being hingedly connected to the second end of the tool body such that the first and second ends of the tool body may be folded so as to assume a compact configuration; and first and second mating sliding sleeves disposed over the first and second ends of the tool body, respectively, such that the mating sliding sleeves may be slid matingly towards one another so that one sliding sleeve is received within a flared end of the other sliding sleeve such that the central portion of the tool body as well as at least portions of the first and second ends are covered by the sliding sleeves so as to aid in locking the tool body in a linear, non-collapsed configuration.

2. A collapsible multi-tool as recited in claim 1, wherein the mating sliding sleeves further comprise a protrusion on one sleeve and a corresponding receiving recess on the other sleeve for locking the sleeves together with the tool body in a linear, non-collapsed configuration.

3. A collapsible multi-tool as recited in claim 2, wherein the corresponding receiving recess is L-shaped.

4. A collapsible multi-tool as recited in claim 2, wherein the corresponding receiving recess is J-shaped.

5. A collapsible multi-tool as recited in claim 1, further comprising a retention ring disposed on the first end of the tool body for preventing the first sliding sleeve from sliding off the first end.

6. A collapsible multi-tool as recited in claim 1, further comprising a protrusion formed on the exterior surface of the first end configured to frictionally engage an interior surface of the sliding sleeve disposed over the first end so as to retain the sliding sleeve over the first end under force of gravity.

7. A collapsible multi-tool as recited in claim 1, further comprising a protrusion formed on the exterior surface of the second end configured to frictionally engage an interior surface of the sliding sleeve disposed over the second end so as to retain the sliding sleeve over the second end under force of gravity.

8. A collapsible multi-tool as recited in claim 1, wherein the curved chisel surface of the first end has a flared width.

9. A collapsible multi-tool as recited in claim 1, wherein the curved chisel surface of the first end is not flared, but has a substantially constant width over its length.

10. A collapsible multi-tool as recited in claim 1, wherein a hinge connecting the central portion to the first end of the tool body has a thickness that is about one-third the thickness of the central portion of the tool body, the central portion further comprising a receiving recess into which the hinge is received, wherein portions on either side of the receiving recess also each comprise about one-third the thickness of the central portion of the tool body so that the hinge and each portion on either side of the hinge of the central portion are approximately equal in thickness.

11. A collapsible multi-tool for use in replacing a tire of a vehicle, comprising:

an elongate tool body including a first end including a curved chisel surface for use in removing a hubcap, an oppositely disposed second end including a ratchet drive head to which a selected socket is attachable for use in removing lug nuts, and a central portion disposed between the opposite first and second ends;

the central portion being hingedly connected to the first end of the tool body by a first hinge, the first hinge being fixed at one end and hingedly connected at a second end, and an opposite end of the central portion also being hingedly connected to the second end of the tool body by a second hinge, the second hinge being fixed at one end and hingedly connected at a second end such that the first and second ends of the tool body may be folded so as to assume a Z-shaped configuration and not a more compact configuration; and first and second mating sliding sleeves disposed over the first and second ends of the tool body, respectively, such that the mating sliding sleeves may be slid matingly towards one another so that one sliding sleeve is received within a flared end of the other sliding sleeve such that the central portion of the tool body as well as at least portions of the first and second ends are covered by the sliding sleeves so as to aid in locking the tool body in a linear, non-collapsed configuration.

12. A collapsible multi-tool as recited in claim 11, wherein the mating sliding sleeves further comprise a protrusion on one sleeve and a corresponding L-shaped or J-shaped receiving recess on the other sleeve for locking the sleeves together with the tool body in a linear, non-collapsed configuration.

13. A collapsible multi-tool as recited in claim 11, further comprising a retention ring disposed on the first end of the tool body for preventing the first sliding sleeve from sliding off the first end.

14. A collapsible multi-tool as recited in claim 11, further comprising a protrusion formed on the exterior surface of the first end configured to frictionally engage an interior surface of the sliding sleeve disposed over the first end so as to retain the sliding sleeve over the first end under force of gravity.

15. A collapsible multi-tool as recited in claim 14, further comprising a protrusion formed on the exterior surface of the second end configured to frictionally engage an interior surface of the sliding sleeve disposed over the second end so as to retain the sliding sleeve over the second end under force of gravity.

16. A collapsible multi-tool as recited in claim 15, wherein the curved chisel surface of the first end has a flared width.

17. A collapsible multi-tool as recited in claim 15, wherein the curved chisel surface of the first end is not flared, but has a substantially constant width over its length.

18. A collapsible multi-tool for use in replacing a tire of a vehicle, comprising:

an elongate tool body including a first end including a curved chisel surface for use in removing a hubcap, an oppositely disposed second end including a ratchet drive head to which a selected socket is attachable for use in removing lug nuts, and a central portion disposed between the opposite first and second ends;

the central portion being hingedly connected to the first end of the tool body at one end of the central portion and an opposite end of the central portion also being hingedly connected to the second end of the tool body such that the first and second ends of the tool body may be folded so as to assume a compact configuration;

wherein a hinge connecting the central portion to the first end of the tool body has a thickness that is about one-third the thickness of the central portion of the tool body, the central portion further comprising a receiving recess into which the hinge is received, wherein portions on either side of the receiving recess also each comprise about one-third the thickness of the central portion of the tool body so that the hinge and each portion on either side of the hinge of the central portion are approximately equal in thickness; and first and second mating sliding sleeves disposed over the first and second ends of the tool body, respectively, such that the mating sliding sleeves may be slid matingly towards one another so that one sliding sleeve is received within a flared end of the other sliding sleeve such that the central portion of the tool body as well as at least portions of the first and second ends are covered by the sliding sleeves so as to aid in locking the tool body in a linear, non-collapsed configuration;

wherein the mating sliding sleeves comprise a protrusion on one sleeve and a corresponding L-shaped or J-shaped receiving recess on the other sleeve for locking the sleeves together with the tool body in a linear, non-collapsed configuration; and further comprising a protrusion formed on the exterior surface of the first end of the tool body configured to frictionally engage an interior surface of the sliding sleeve disposed over the first end so as to retain the sliding sleeve over the first end under force of gravity.

19. A collapsible multi-tool as recited in claim 18, wherein the curved chisel surface of the first end has a flared width.

20. A collapsible multi-tool as recited in claim 18, wherein the curved chisel surface of the first end is not flared, but has a substantially constant width over its length.

* * * * *

UNITED STATES PATENT AND TRADEMARK OFFICE

CERTIFICATE OF CORRECTION

PATENT NO. : 8,448,545 B1
APPLICATION NO. : 13/039149
DATED : May 28, 2013
INVENTOR(S) : Argyle It is certified that error appears in the above-identified patent and that said Letters Patent is hereby corrected as shown below:

In the Drawings

Sheet 10, replace Figure 6 with the attached fig., wherein the label 115 is modified to read 115'

In the Specification

Column 1
Line 43, change "removing lug nuts and tire, (5) position spare tire" to --removing the lug nuts and tire, (5) positioning the spare tire--
Line 60, change "leaving the flared at one end" to --leaving the flared chisel end at one end--

Column 3
Line 31, change "Ratchet drive head" to --ratchet drive head--
Line 48, change "hinges 112" to --hinges 110--

Column 5
Line 42, change "end 104" to --end 104'--
Line 64, change "L-shaped slot 117" to --L-shaped slot 117'--

Column 6
Line 4, change "sleeves 114, 116" to --sleeves 114', 116'--
Line 21, change "formed near and end" to --formed near an end--

Signed and Sealed this
Third Day of February, 2015

Michelle K. Lee

Michelle K. Lee
*Deputy Director of the United States Patent and Trademark Office*